US008740262B2

(12) United States Patent
Buchheit

(10) Patent No.: US 8,740,262 B2
(45) Date of Patent: Jun. 3, 2014

(54) PUSH BUTTON ASSEMBLY FOR OPENING AND CLOSING A GLOVEBOX FOR A VEHICLE

(75) Inventor: Nathaniel J. Buchheit, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 474 days.

(21) Appl. No.: 13/004,545

(22) Filed: Jan. 11, 2011

(65) Prior Publication Data

US 2012/0175891 A1 Jul. 12, 2012

(51) Int. Cl.
*E05C 1/08* (2006.01)
*E05C 1/00* (2006.01)

(52) U.S. Cl.
USPC ..... 292/163; 292/174; 292/DIG. 37

(58) Field of Classification Search
USPC ..... 292/32, 41, 42, 163, 174, DIG. 37, 292/DIG. 38
See application file for complete search history.

(56) References Cited

U.S. PATENT DOCUMENTS 4,239,269 A * 12/1980 Chiang ..... 292/175
4,864,835 A * 9/1989 Wartian ..... 70/107
5,626,374 A 5/1997 Kim
6,471,263 B1 * 10/2002 Choo ..... 292/336.3
6,896,302 B2 * 5/2005 Belchine et al. ..... 292/336.3
7,156,440 B2 1/2007 Katagiri
7,175,144 B2 * 2/2007 Yen et al. ..... 248/221.11
7,393,024 B2 * 7/2008 Bella ..... 292/170
7,410,194 B2 * 8/2008 Chen et al. ..... 292/37
7,451,628 B1 11/2008 Kim
7,475,929 B2 * 1/2009 Yamada ..... 296/24.34
7,766,409 B2 8/2010 Ohnuki
7,806,446 B2 * 10/2010 Oh ..... 292/165
7,832,239 B2 * 11/2010 Kozuka et al. ..... 70/162
2004/0017088 A1 1/2004 Sawatani et al.
2008/0022730 A1 1/2008 Dietrich et al.
2009/0152877 A1 6/2009 Kim

* cited by examiner

*Primary Examiner* — Carlos Lugo
(74) *Attorney, Agent, or Firm* — Rankin, Hill & Clark LLP

(57) ABSTRACT

An opening and closing assembly for a storage compartment provided on a dashboard of a vehicle comprises a first housing, a push button including a first slider, a second housing and a second slider. The push button is movably supported on the first housing. The first slider has a first inclined face at a rear end thereof. The second housing is mounted adjacent the first housing. The second slider is movably supported on the second housing. The second slider includes at least one clip on one end for connecting the second slider to the second housing and a second inclined face on the other end. A longitudinal axis of the second slider is substantially perpendicular to a longitudinal axis of the first slider such that the second inclined face faces the first inclined face of the first slider. The at least one clip of the second slider is movable toward a striker to unlock the storage compartment when the second inclined face is pressed by the first inclined face.

19 Claims, 8 Drawing Sheets

PUSH BUTTON ASSEMBLY FOR OPENING AND CLOSING A GLOVEBOX FOR A VEHICLE

BACKGROUND

Exemplary embodiments herein generally relate to a push button assembly for opening and closing a storage compartment or closure, such as a receptacle or glovebox, in a vehicle.

A variety of opening and closing assemblies for a vehicle storage compartment or glovebox are known. In one known arrangement, the opening and closing assembly is located in a cutout of the glovebox door, located on an outer surface of the door, or mounted on an instrument panel or dashboard or other like vehicle structure. Sometimes an electric lock is included. A typical known assembly includes a latch mounted to either the glovebox door or the dashboard, a push button mounted to the other one of the door or the dashboard, a rack bar connected to the push button and extending inward, a pinion engaged with the rack bar, and a link having a rack gear engaged with the pinion. The link is movable to lock and unlock the latch. Because the known design typically includes the latch, which is unlocked through the rack and pinion mechanism, the assembly has complicated structures and, in certain instances, is not effective.

BRIEF DESCRIPTION

In accordance with one aspect, an opening and closing assembly for a storage compartment provided on a dashboard of a vehicle comprises a first housing, a push button including a first slider, a second housing and a second slider. The push button is movably supported on the first housing. The first slider has a first inclined face at a rear end thereof. The second housing is mounted adjacent the first housing. The second slider is movably supported on the second housing. The second slider includes at least one clip on one end for connecting the second slider to the second housing and a second inclined face on the other end. A longitudinal axis of the second slider is substantially perpendicular to a longitudinal axis of the first slider such that the second inclined face faces the first inclined face of the first slider. The at least one clip of the second slider is movable toward a striker to unlock the storage compartment when the second inclined face is pressed by the first inclined face.

In accordance with another aspect, an opening and closing assembly for a storage compartment provided on a structure of a vehicle comprises a first housing, a push button including a first slider, a second housing and a second slider. The first housing is mounted on the structure. The push button is movably supported on the first housing and further includes an overstroke member for preventing the push button from being overstroked past a predetermined length. The first slider has a first inclined face at a rear end thereof. The second housing is mounted to one of the first housing and the structure and includes a guide member. The second slider is supported on the second housing and movable on the guide member. The second slider has a second inclined face on one end corresponding to the first inclined face of the first slider. The second slider is movable in a transverse direction relative to the first slider to unlock the storage compartment when the second inclined face is biased transversely by the first inclined face.

In accordance with yet another aspect, an opening and closing assembly for a glovebox provided on a dashboard of a vehicle comprises a first housing, a push button including a first slider, a second housing and a second slider. The first housing is mounted on one of the glovebox and the dashboard. The push button is movably supported within the first housing. The first slider has a first inclined face at a rear end thereof. The first inclined face projects outwardly from a rear end of the first housing. The second housing is mounted to a flange extending outwardly from the first housing. The second housing includes a guide member provided on an inner surface thereof. The second slider is supported on and extends through the second housing. The second slider has an elongated channel dimensioned to slidably receive the guide member and a second inclined face corresponding to the first inclined face of the first slider. The second slider is movable in a transverse direction relative to the first slider to unlock the glovebox when the second inclined face is biased transversely by the first inclined face. At least one biasing member is associated with the first housing for biasing the first slider away from the second slider. At least one biasing member is associated with the second housing for biasing the second slider toward the first slider.

DETAILED DESCRIPTION

It should, of course, be understood that the description and drawings herein are merely illustrative and that various modifications and changes can be made in the structures disclosed without departing from the present disclosure. It will also be appreciated that the various identified components of the exemplary opening and closing assembly for a storage compartment provided on a structure of a vehicle disclosed herein are merely terms of art that may vary from one manufacturer to another and should not be deemed to limit the present disclosure.

Figure 1:
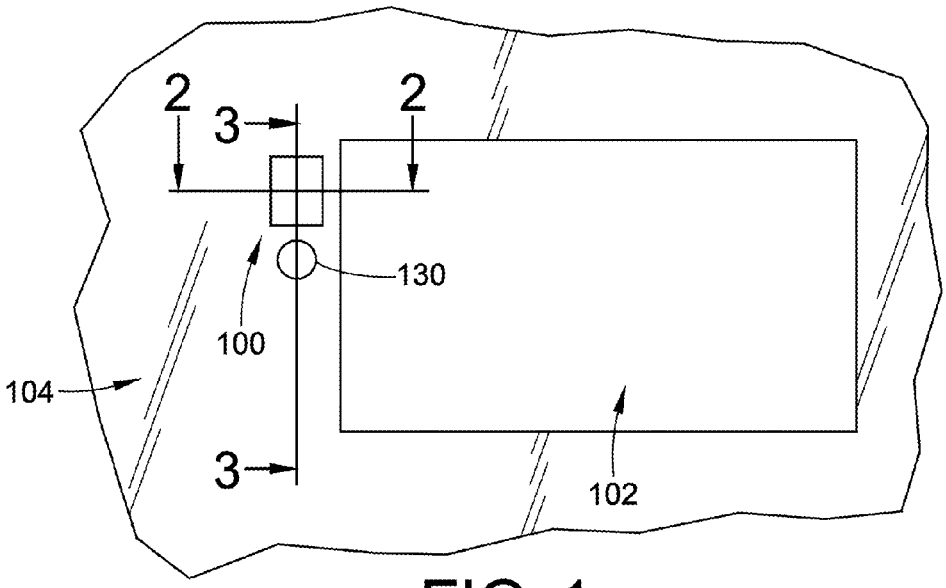
FIG. 1 schematically illustrates an exemplary opening and closing assembly for a storage compartment provided on a structure of a vehicle according to the present disclosure.
Figure 2:
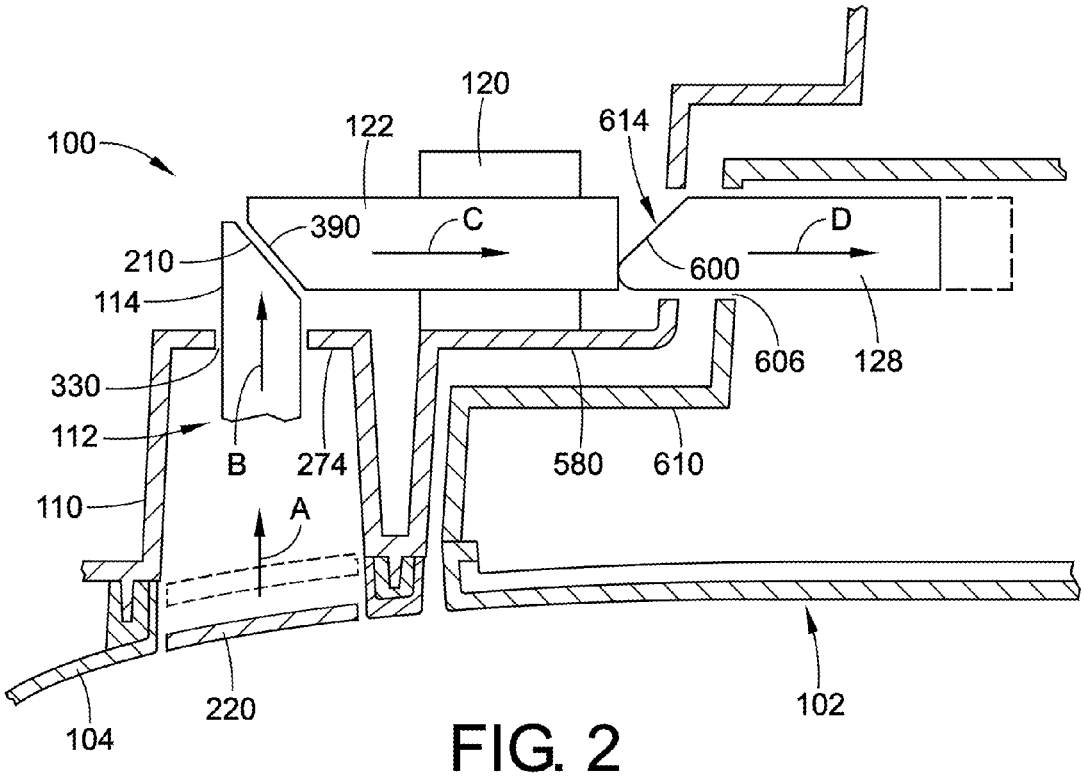
FIG. 2 is a cross-sectional view of the assembly of FIG. 1 taken generally along line 2-2 of FIG. 1.
Figure 3:
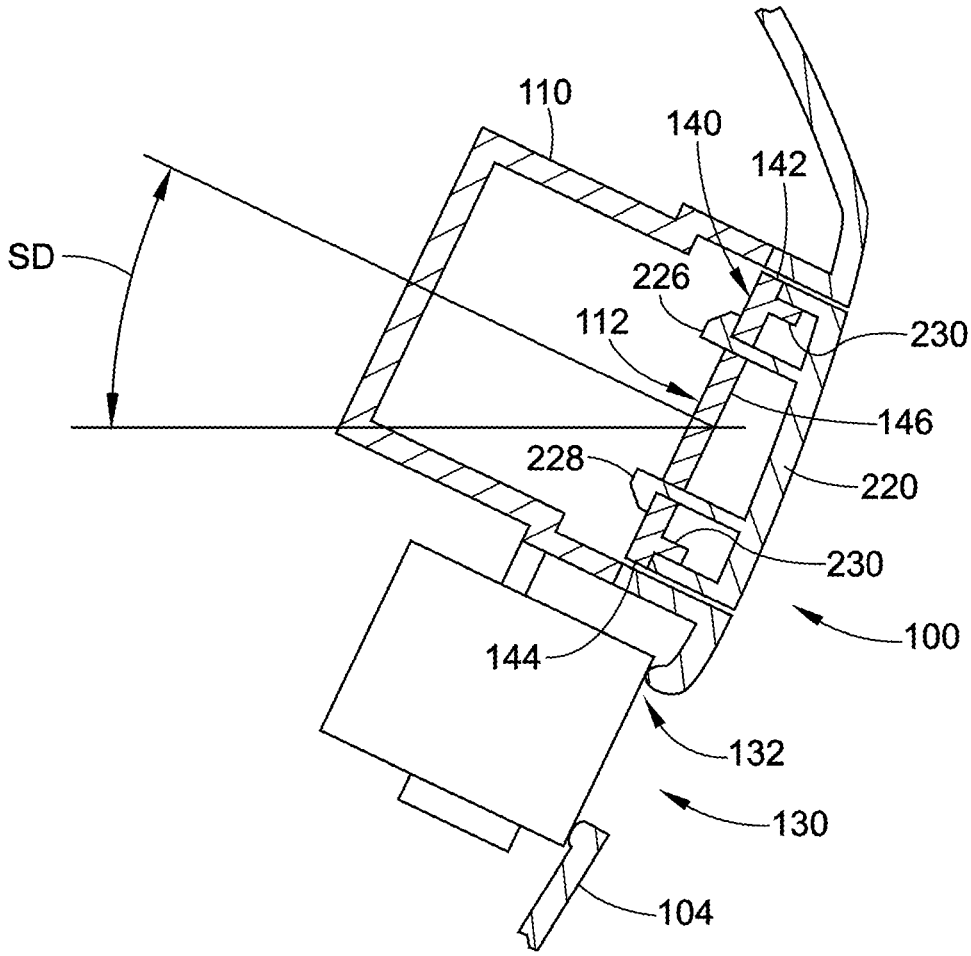
FIG. 3 is a cross-sectional view of the assembly of FIG. 1 taken generally along line 3-3 of FIG. 1.

Referring now to the drawings, wherein like numerals refer to like parts throughout the several views, FIGS. 1-3 schematically illustrate an exemplary opening and closing assembly 100 for a storage compartment 102 provided on a vehicle structure 104. The storage compartment 102 can be a glovebox, receptacle or other like closure and the vehicle structure 104 can be an instrument panel, dashboard or other like structure. The opening and closing assembly generally comprises a first housing 110, a push button 112 including a first slider 114, a second housing 120 and a second slider 122. As will be discussed in greater detail below, the first housing 110 can be mounted on the structure or dashboard 104. The push button 112 is movably supported on the first housing 110. In the depicted exemplary embodiment, the stroke direction SD of the push button 112 in the first housing 110 is about twenty-five degrees (25°) relative to a horizontal axis, which allows for easy depression of the push button 112. The second housing 120 is adjacent the first housing 110 and can be mounted to one of the dashboard 104 or the first housing 110. The second slider 122 is movably supported on the second housing 120. The second slider 122 is movable toward a striker 128 associated with the storage compartment or glovebox 102 to open or unlatch the glovebox 102 when the second slider 122 is pressed by the first slider 114. A lock mechanism 130 can be operatively associated with the opening and closing assembly 100; although, this is not required. As shown, the lock assembly is mounted in an opening 132 provided in the dashboard 104 adjacent the push button 112 and is configured to prevent the push button 112 from being depressed in the first housing 110 and lock the glovebox 102 in the closed position.

Figure 6:
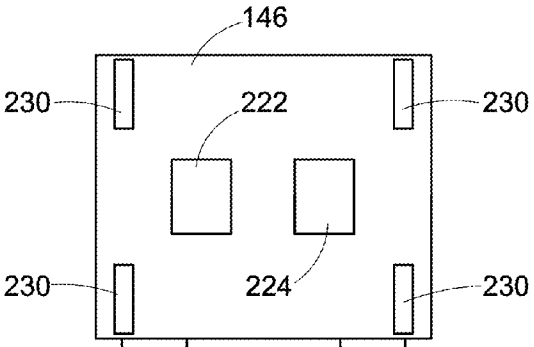
FIG. 6 is a front elevation view of the push button of FIG. 5.
Figure 4:
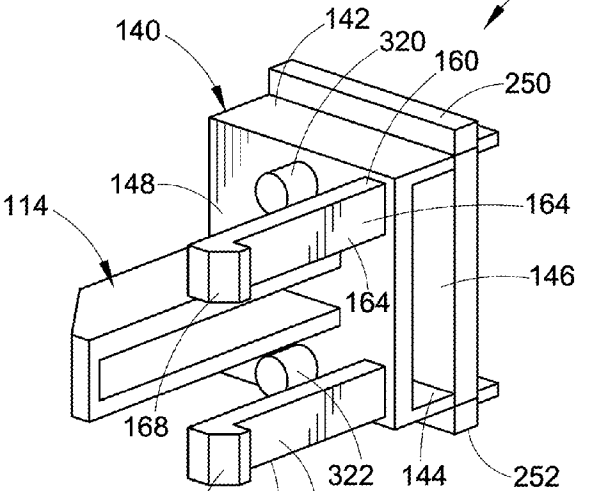
FIG. 4 is a perspective view of a push button having a first slider of the assembly of FIG. 2.
Figure 5:
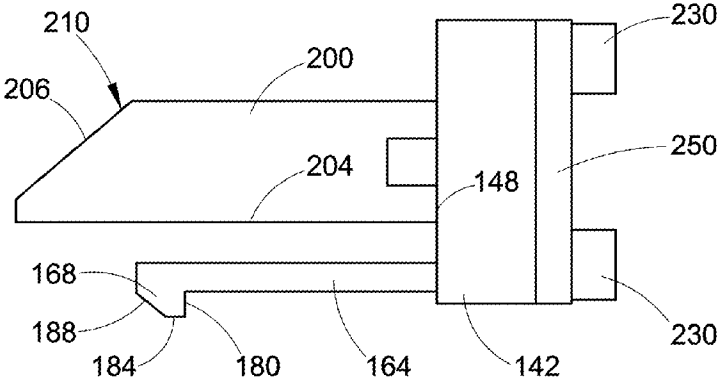
FIG. 5 is a side elevation view of the push button of FIG. 4 rotated ninety degrees.

With reference to FIGS. 4-6, the push button 112 of the illustrated embodiment includes a generally box-shaped base member 140. The base member 140 includes side walls 142 and 144, a top wall 146 and a bottom wall 148. The first slider 114 and at least one clip or attachment member for connecting the push button 112 to the first housing 110 extend outwardly from a bottom surface of the base member 140. As depicted, the at least one clip of the illustrated embodiment includes a first clip 160 and a second clip 162 spaced from the first clip 160. Each clip 160,162 includes a respective arm portion 164,166 and a respective finger portion 168,170. Each finger portion 168,170 extends outwardly from a respective first end of each arm portion 164,166. A second end of each arm portion 164,166 is fixed to the bottom wall 148 of the base member 140. In the illustrated exemplary embodiment, each finger portion 168,170 is generally triangular shaped and includes a respective first surface 180,182, a second surface 184,186 and a third inclined surface 188,190. The first surfaces 180,182 extend generally perpendicularly from the arm portions 164,166. The second surfaces 184,186 extend generally perpendicularly from the first surfaces 180,182 and generally parallel to the arm portions 164, 166. The third inclined surfaces 188,190 span between the second surfaces 184,186 and the arm portions 164,166.

The first slider 114 of the push button 112 extends outwardly from the bottom wall 148 of the base member 140 and is generally interposed between the first and second clips 160,162. As shown, the exemplary first slider 114 is generally rectangular shaped and includes first and second side walls 200 and 202, a base wall 204, and an end wall 206. Each of the first and second side walls 200,202 is oriented generally perpendicular to the base wall 204. The end wall 206 defines a first inclined face 210 of the first slider 114 that is provided at a rear end of the first slider. As will be discussed in greater detail below, the first inclined face 210 selectively engages the second slider 122, which, in turn, causes the second slider 122 to move toward the striker 128.

A top surface of the base member 140 of the push button 112 is adapted for the connection of a cover or button 220 (FIG. 12) thereto. Particularly, the top wall 146 includes at least one opening and the button 220 includes at least one clip configured to be securely received in the at least one opening provided in the top wall 146. As shown, the top wall 146 includes a pair of openings 222,224 and the button includes a pair of clips 226,228. The top surface of the base member 140 further includes at least one rib for controlling the location of the button 220 on the top surface. In the illustrated embodiment, the top wall 146 includes four spaced apart ribs 230. Each rib 230 is generally rectangular shaped and has a lengthwise dimension which extends along a lengthwise dimension of each side wall 142,144. It should be appreciated that alternative shapes for the ribs 230 are contemplated, and that the ribs can have different orientations relative to the side walls 142,144.

Figure 7:
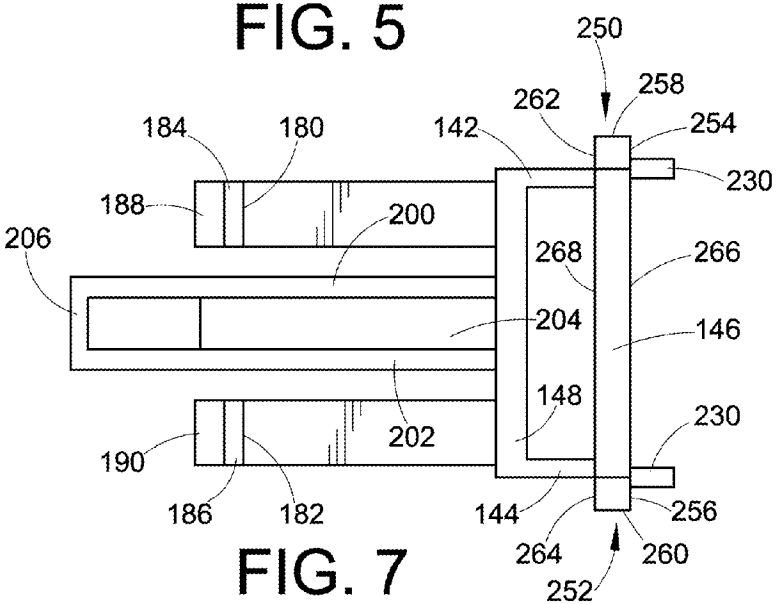
FIG. 7 is another side elevation view of the push button of FIG. 4.

With reference to FIGS. 4 and 7, the base member 140 further includes at least one overstroke ledge provided on at least one of the side walls 142, 144 for preventing the push button 112 from being overstroked past a predetermined length. Particularly, in the depicted embodiment, each of the side walls 142,144 includes a respective overstroke ledge 250,252. The overstroke ledges 250,252 are generally rectangular shaped and extend along substantially the entire longitudinal extent of the respective side walls 142,144. Overstroke ledge 250 includes a top surface 254, a side surface 258 and a bottom surface 262. Overstroke ledge 252 includes a top surface 256, a side surface 260 and a bottom surface 264. The top surfaces 254,256 lie substantially in the same plane defined by a top surface 266 of the top wall 146. The bottom surfaces 262,264 lie substantially in the same plane defined by a bottom surface 268 of the top wall 146. The side surfaces 258,260 extend substantially parallel to the side walls 142, 144. As shown in FIGS. 4 and 7, the overstroke ledges 250, 252 can be separate members which are fixedly attached to the side walls 142,144. Alternatively, the overstroke ledges 250,252 can be integrally formed with the base member 140, as shown in FIG. 11.

Figure 10:
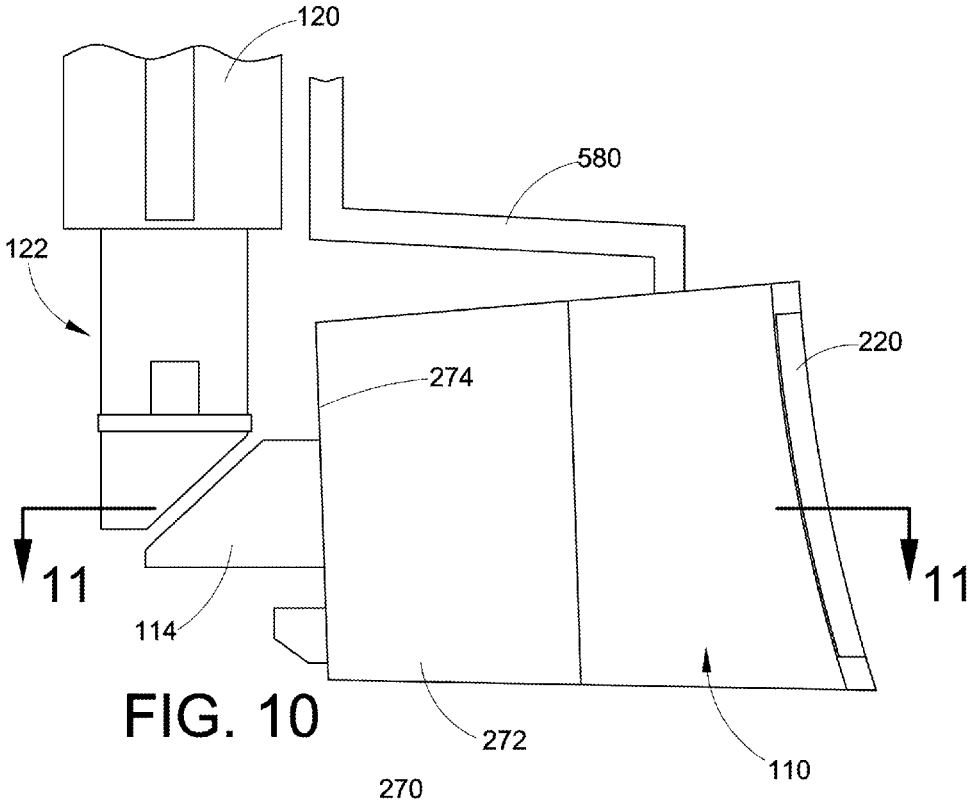
FIG. 10 is a front elevation view of the push button and the first housing of FIG. 8 rotated ninety degrees.
Figure 11:
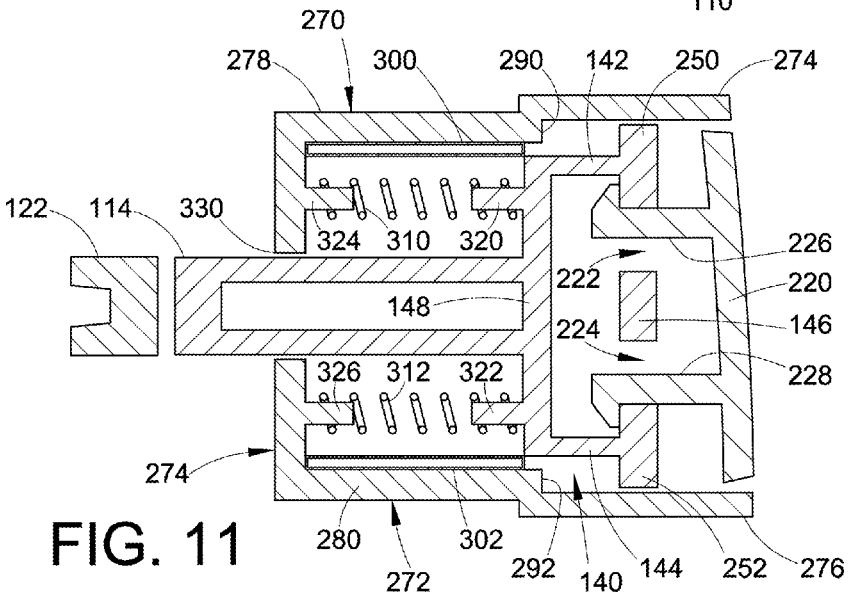
FIG. 11 is a cross-sectional view of the push button and the first housing of FIG. 10 taken generally along line 11-11 of FIG. 10.

With reference now to FIGS. 10 and 11, the first housing 110 includes side walls 270 and 272 and a bottom wall 274. Each side wall 270,272 includes a respective first portion 274,276 and a respective second portion 278,280, which is offset inwardly from the first portion 274, 276. This offset between the first and second portions of each side wall 270, 272 defines an overstroke ledge 290 and 292. The overstroke ledges 290,292 of the first housing 110 are selectively engaged by the overstroke ledges 250,252 provided on the base member 140 of the push button 112. This engagement prevents the push button from being overstroked.

The first housing 110 further includes at least one tuning rib provided on an inner surface of the first housing for preventing the push button 112 from rotating or moving up and down during stroke of the push button 112 within the first housing 110. In the illustrated exemplary embodiment, a first tuning rib 300 is provided on the first wall 270 and a second tuning rib 302 is provided on the second wall 272. More particularly, each tuning rib 300,302 is generally rectangular shaped and is fixedly secured to the second portion 278,280 of each side wall 270,272. An upper end of each tuning rib 300,302 is spaced inwardly from each overstroke ledge 290,292 toward the bottom wall 274. The tuning ribs 300,302 are dimensioned such that once secured to the second portion 278,280 of each side wall 270,272, spacing between the tuning ribs 300,302 is approximately equal to a lengthwise dimension of the bottom wall 148 of the base member 140. Thus, the base member 140 is slidingly received between the tuning ribs 300, 302 and is prevented from rotating or moving during stroke of the push button 112.

The push button 112 further includes at least one biasing member for biasing the push button outwardly relative to the first housing 110, and particularly away from the bottom wall 274 of the first housing 110 toward the dashboard 104. As shown in FIG. 11, the at least one biasing member can include a first compression spring 310 and a second compression spring 312. Compression spring 310 has one end portion connected to a projection 320 provided on the push button 112 and the other end portion connected to a projection 324 provided on an inner surface of the first housing 110. Similarly, compression spring 312 has one end portion connected to a projection 322 provided on the push button 112 and the other end portion connected to a projection 326 provided on the first housing 110. With reference back to FIG. 4, the projections 320,322 are located on the bottom wall 148 of the base member 140 and extend toward the first inclined face 210 of the first slider 114. The projections 320,322 are separated by the first slider 114 such that projection 320 is provided between side wall 200 of the first slider and side wall 142 of the base member 140, and projection 322 is located between side wall 202 of the first slider 114 and side wall 144 of the base member. With reference again to FIG. 11, projections 324,326 are provided on the bottom wall 274 of the first housing 110. Projection 324 is aligned with projection 320 and projection 326 is aligned with projection 322.

Figure 8:
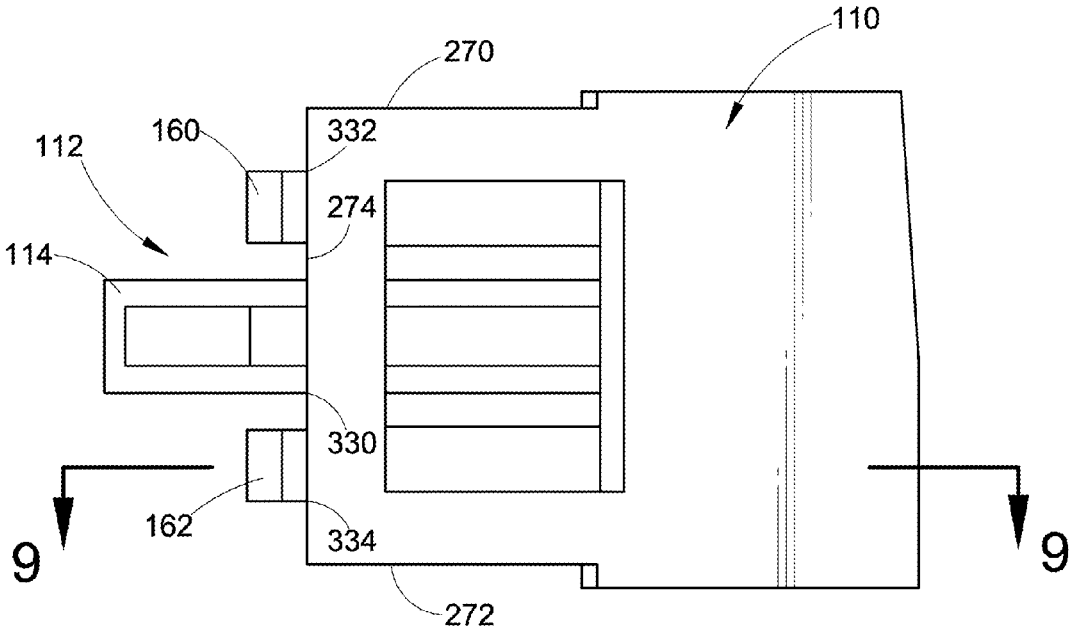
FIG. 8 is a side elevation view of the push button of FIG. 4 moveably supported in a first housing of the assembly of FIG. 2.
Figure 9:
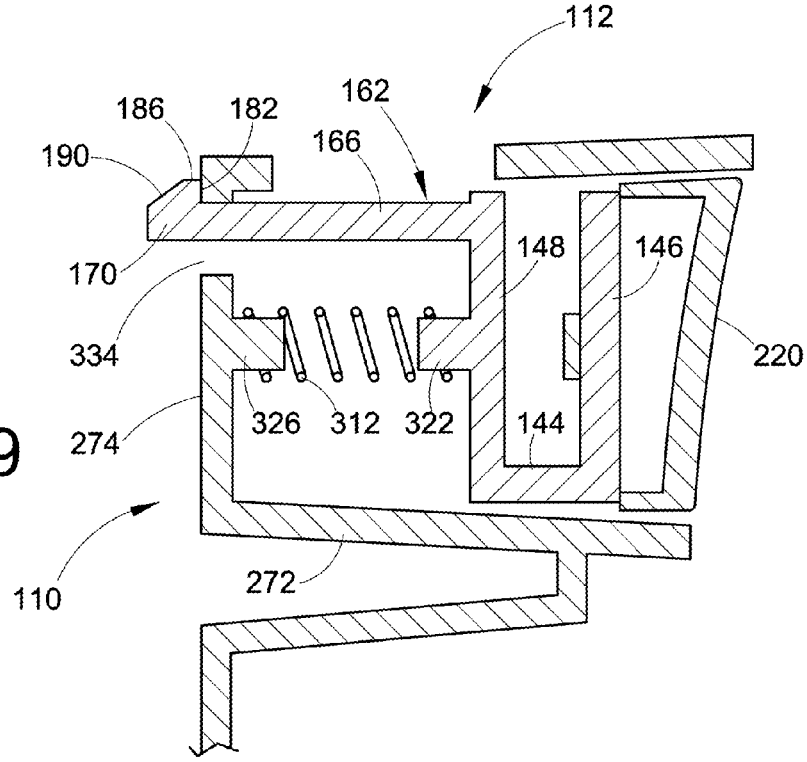
FIG. 9 is a cross-sectional view of the push button and the first housing of FIG. 8 taken generally along line 9-9 of FIG. 8.

FIGS. 8 and 9 depict the moveable mounting of the push button 112 to the first housing 110. The bottom wall 274 of the first housing 110 includes an opening 330 through which the first inclined face 210 of the first slider 114 projects. The bottom wall 274 further includes a pair of openings 332 and 334 for receiving the respective clips 160 and 162 provided on the push button 112. Once inserted through the openings 332,334, the finger portion 168,170 of each clip 160,162 selectively engages the bottom wall 274 of the first housing 110. This prevents the push button 112 from falling out of the first housing 110.

More particularly, FIG. 9 depicts clip 162 secured to the bottom wall 274. Once positioned in the opening 334, the first surface 182 of the finger portion 170 engages the bottom wall 274. The opening 334 has a center line spaced slightly inwardly from a longitudinal axis of the clip 162 such that the arm portion 164 is slightly spaced from or in contact with a portion of the bottom wall 274 which defines the opening 334. This offset positioning between the opening 334 and the clip 162 ensures that the clip remains engaged with the bottom wall 274. Specifically, as the push button 112 is being inserted in the first housing 110, the inclined surface 190 engages the bottom wall 274 as the clip 162 is being inserted into the opening 334. This engagement biases the clip inwardly as the bottom wall 274 slides against the inclined surface 190. Once the bottom wall 274 slides past the inclined surface 190 and the second surface 186 of the finger portion 170, the clip 162 moves back to its original position such that the wall 174 is positioned between the first surface 182 and the arm portion 166 of the clip 162. Clip 160 is engaged to the wall 274 in a similar manner.

Figure 12:
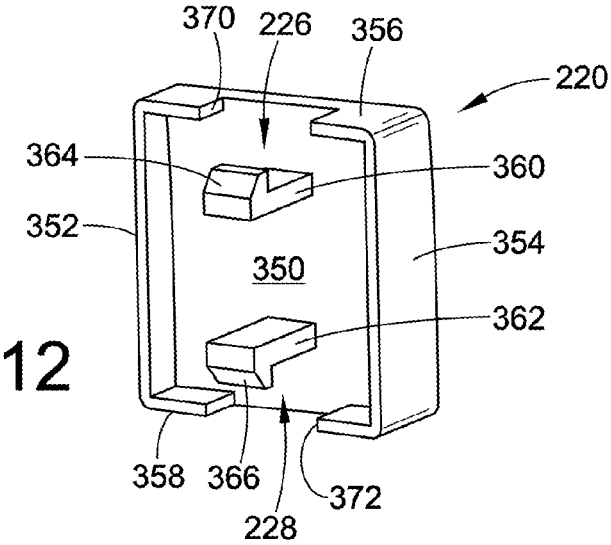
FIG. 12 is a perspective view of a button of the assembly of FIG. 2.
Figure 14:
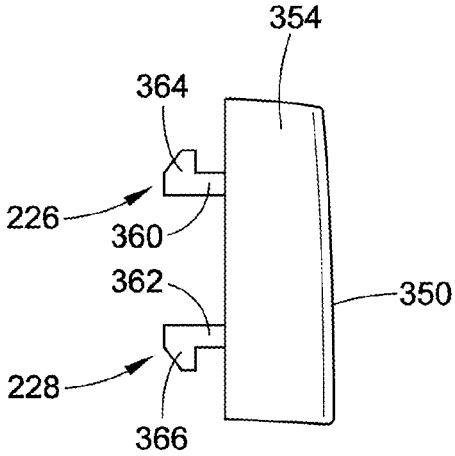
FIG. 14 is a front elevation view of the button of FIG. 12.
Figure 13:
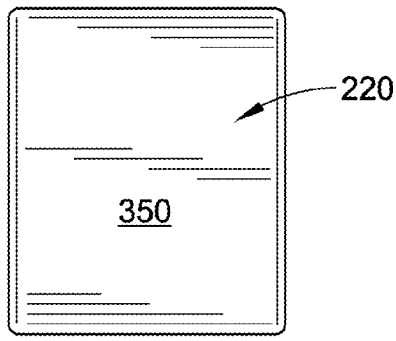
FIG. 13 is a side elevation view of the button of FIG. 12.

With reference now to FIGS. 12-14, as indicated above, the button 220 is secured to the top wall 146 of the base member 140. The button 220 is generally box-shaped and includes a top wall 350, side walls 352 and 354 and end walls 356 and 358. The clips 226,228 for securing the button 220 to the base member 140 extend outwardly from a bottom surface the top wall 350. Similar to the clips 160,162, the clips 226,228 include a respective arm portion 360,362 and a respective finger portion 364,366. Each finger portion 364,366 is generally triangular shaped which provides for a similar attachment of the clips 226,228 to the top wall 146 of the base member 140 as the clips 160,162 to the bottom wall 274 of the first housing 110. The end walls 356,358 can include cutouts 370,372 which allow for easy disengagement of the button 220 from the base member 140. With reference back to FIG. 3, the ribs 230 provided on the to wall 146 of the base member 140 control the location of the button 220 on the base member 140. The ribs 230 are spaced inwardly from the side walls 142,144 a predetermined distance such that the ribs 230 engage an inner surface of the button end walls 356,358.

Figure 15:
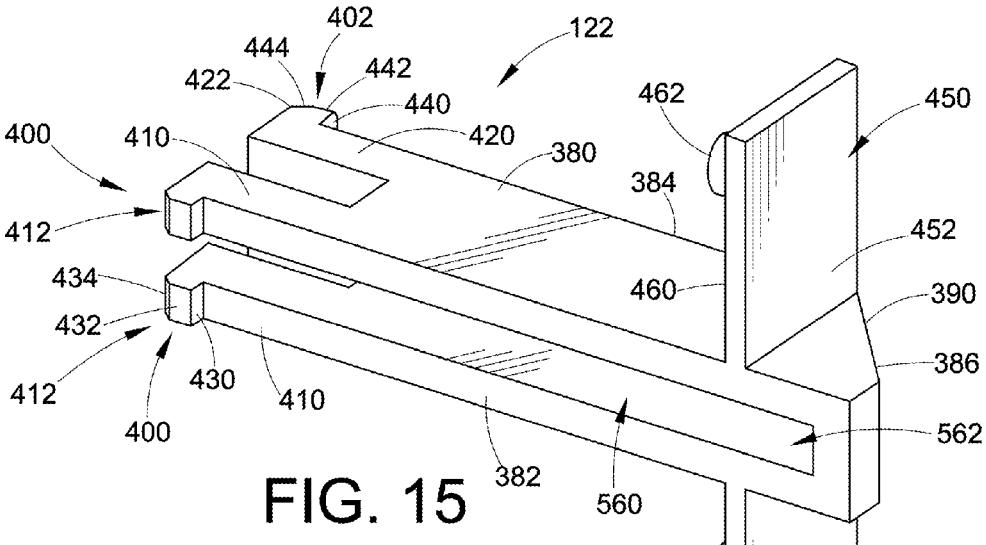
FIG. 15 is a perspective view of a second slider of the assembly of FIG. 2.

The second slider 122 is best depicted in FIG. 15. The second slider 122 is generally rectangular shaped and includes a first side wall 380, a second side wall 382, a base wall 384, and an end wall 386. Each of the first and second side walls 380,382 is oriented generally perpendicular to the base wall 384. Similar to the first slider 114, the end wall 386 defines a second inclined face 390 provided at one end of the second slider 122. The other end of the second slider 122 includes at least one clip for connecting the second slider to the second housing 122. In the depicted exemplary embodiment, the second slider 122 includes a pair of first clips 400 and a second clip 402. One of the first clips 400 extends outwardly from an end of the first side wall 380 and the other of the first clips extends outwardly from an end of the second side wall 382. The second clip 402 extends outwardly from an end of the base wall 384. Each of the first clips 400 includes an arm portion 410 and a generally triangular finger portion 412. Each finger portion 412 of the first clips 400 includes a first surface 430, a second surface 432 and a third inclined surface 434. The first surface 430 extends generally perpendicularly from the arm portion 410. The second surface 432 extends generally parallel to the arm portion 410. The inclined surface 434 extends between the second surface 432 and the arm portion 410. Similarly, the second clip 402 includes an arm portion 420 and a generally triangular finger portion 422. The finger portion 422 includes a first surface 440, a second surface 442 and a third inclined surface 444. The first surface 440 extends generally perpendicularly from the arm portion 420. The second surface 442 extends generally parallel to the arm portion 420. The third surface 444 extends between the arm portion 420 and the second surface 442.

The second slider 122 further includes a base member 450 located adjacent the second inclined face 390. The base member 450 is separated into a first portion 452 and a second portion 454. The first portion 452 extends perpendicularly from the first side wall 380. The second portion 454 extends perpendicularly from the second side wall 382. A bottom surface 460 of the first portion 452 includes a projection 462. Similarly, a bottom surface 464 of the second portion 454 includes a projection 466.

Figure 16:
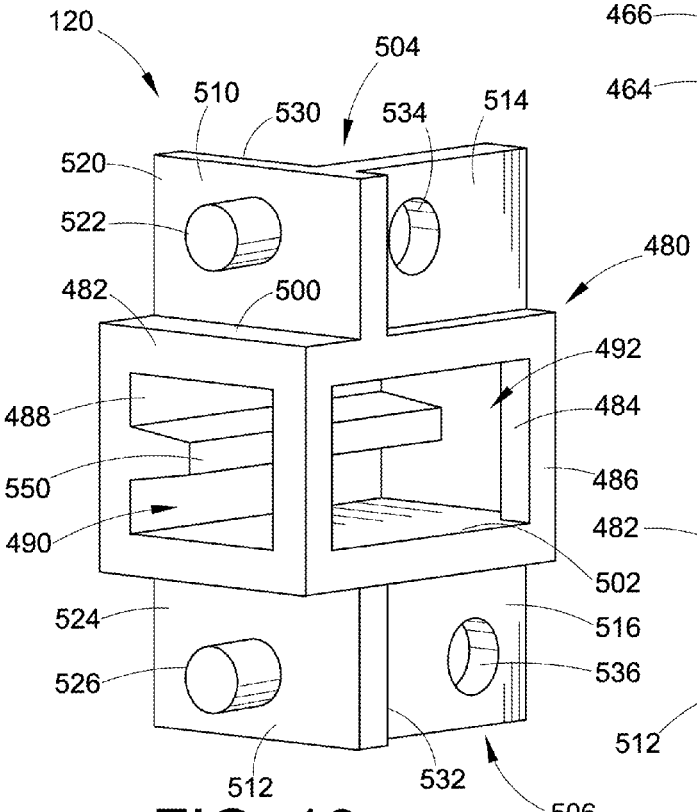
FIG. 16 is a perspective view of a second housing of the assembly of FIG. 2.
Figure 17:
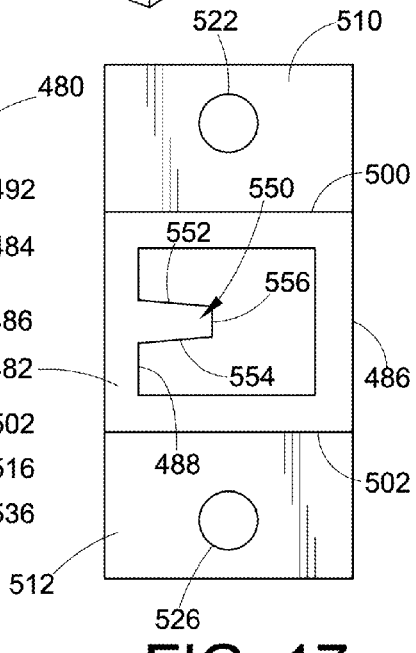
FIG. 17 is a side elevation view of the second housing of FIG. 16.

As indicated previously, the second slider 122 is movably supported on the second housing 120. With reference to FIGS. 16 and 17, the second housing 120 includes a generally box-shaped base member 480 having side walls 482 and 484, a top wall 486 and a bottom wall 488. Each of the side walls 482,484 includes a respective opening 490,492 dimensioned to slidably receive the second slider 122 thereby allowing the second slider 122 to move through the second housing 120. The base member 480 further includes end walls 500 and 502 having generally T-shaped flanges 504,506 projecting outwardly therefrom. Each flange 504,506 includes a respective first portion 510,512 and a respective second portion 514,516. The first portion 510,512 of each flange 504,506 extends perpendicularly from the end wall 500,502 and transverse to a lengthwise dimension of the end wall 500,502. A bottom surface 520 of first portion 510 includes a projection 522, and a bottom surface 524 of first portion 512 includes a projection 526. The second portion 514,516 of each flange 504,506 extends perpendicularly from a top surface 530,532 of the first portion 510,512 along the lengthwise dimension of the end walls 500,502. An aperture 534 is provided on the second portion 514 and an aperture 536 is provided on the second portion 516. As will be discussed in greater below, the apertures allow for the mounting of the second housing 120 to one of the dashboard 104 and the first housing 110.

With continued reference to FIGS. 16 and 17, the second housing 120 includes a guide member or guide rib 550 located on an inner surface thereof. The guide member 550 engages the second slider 122 and provides a track for the second slider to travel. In the depicted exemplary embodiment, the guide member 550 extends outwardly from the bottom wall 488 of the base member 480. The guide member 550 includes side surfaces 552,554 and a top surface 556. The side surfaces 552,554 can be canted outwardly toward the bottom wall 488; although, this is not required. With reference back to FIG. 15, the second slider 122 includes an elongated channel 560 dimensioned to slidably receive the guide member 550 of the second housing 120. The elongated channel 560 is defined by the spacing between the first and second side walls 380, 382 and extends approximately the entire length of the second slider 122. An end 562 of the elongated channel 560 is closed by the second inclined face 390 of the second slider 122.

Figure 18:
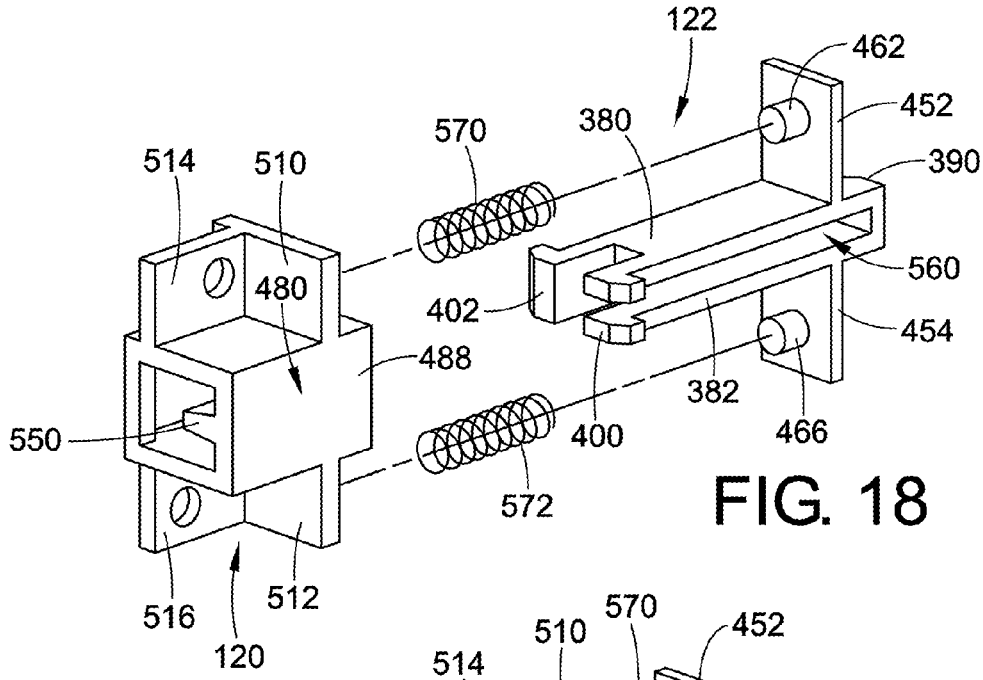
FIG. 18 is an exploded perspective view depicting the assembly of the second slider of FIG. 15 to the second housing of FIG. 16.
Figure 19:
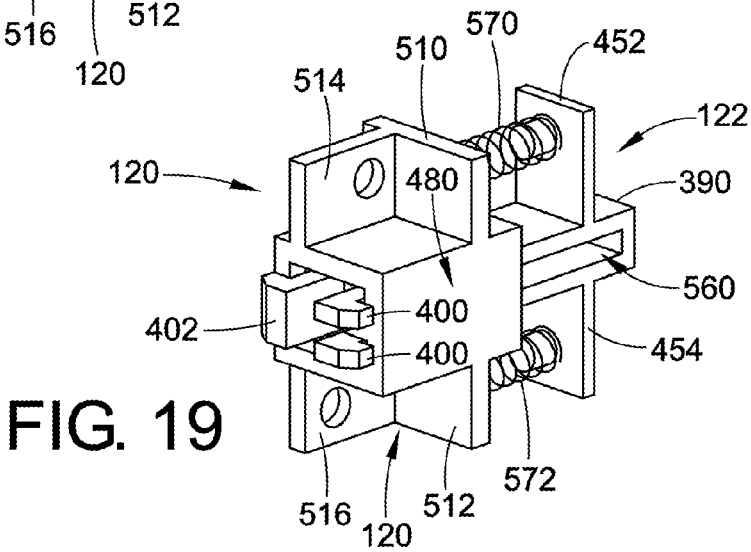
FIG. 19 is a perspective view of the second slider of FIG. 15 supported on the second housing FIG. 16.
Figure 20:
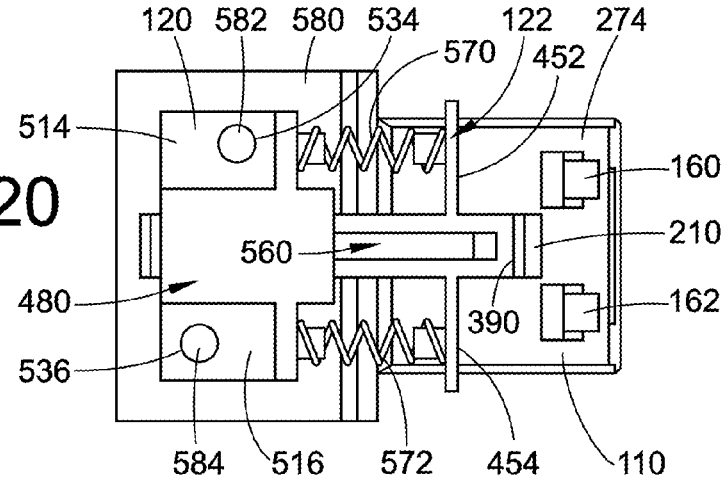
FIG. 20 is a bottom plan view of the second slider and second housing of FIG. 19 mounted to the first housing of FIG. 10.

The mounting of the second slider 122 to the second housing 120 is depicted in FIGS. 18-20. The second slider 122 is slid through the openings 490,492 of the base member 480 with the guide member 550 being received in the elongated channel 560. Once positioned in the base member 480, the pair of first clips 400 and the second clip 422 provided on the second slider 122 selectively engage side wall 484 of the base member 480. The engagement of each clip 400,402 to the side wall 484 is generally similar to the engagement of the clips 160,162 to the base member 140. As such, detailed description of the engagement of the first and second clips 400,402 to the second housing 120 is omitted for conciseness. At least one biasing member is provided for biasing the second slider 122 toward the first slider 112. The at least one biasing member includes a first compression spring 570 and a second compression spring 572. Compression spring 570 has one end portion connected to projection 522 provided on first portion 510 of flange 504 and the other end portion connected to projection 462 provided on first portion 452 of base 450. The second compression spring 572 has one end portion connected to projection 526 provided on first portion 512 of flange 506 and the other portion connected to projection 466 provided on second portion 554 of base 450.

As indicated previously, the second housing 122 can be secured to one of the dashboard 104 and the first housing 110. In the depicted exemplary embodiment of FIG. 20, the second housing 122 is mounted to a flange 580 provided on the first housing 110. The flange 580 is provided with a pair of bosses 582,584 dimensioned to be received in the respective apertures 534,536 provided on the flanges 504,506 of the second housing 120. Once positioned in the apertures 534,536, fasteners, such as screws, threadingly engage the bosses 582,584 thereby securely attaching the second housing 120 to the first housing 110. Once secured to the first housing, the second a longitudinal axis of the second slider 122 is substantially perpendicular to a longitudinal axis of the first slider 114. With this orientation, the second inclined face 390 of the second slider 122 faces the first inclined face 210 of the first slider 114. The second inclined face 390 corresponds to the first inclined face 210.

With reference again to FIG. 2, the first housing 110 can be mounted on the dashboard 104. The second housing 120 can be mounted on the flange 580 provided on the first housing 110. The second slider 122 is movable in a transverse direction relative to the first slider 114 to unlock the glovebox 102 when the second inclined face 390 is biased transversely by the first inclined face 210. The striker 128 projects through an opening 606 provided in a wall 610 of the glovebox 102 and through an opening 614 provided in the flange 580 of the first housing 110. The striker 128 includes an inclined face 600 which is engaged by one of the first and second clips 400,402 provided on the second striker 122 as the second slider 122 moves through the second housing 120. This engagement of the striker 128 by the second slider 122 causes the striker 128 to slide through the openings 614 and 606, which unlatches the glovebox 102 allowing the glovebox to be opened.

More particularly, depression of the push button 112 as indicated by arrow A moves the first slider 114 inwardly in the direction of arrow B through the opening 330 provided on the bottom wall 274 of the first housing 110. As the first inclined face 210 also moves in the direction of arrow B, the first inclined face 210 engages the second inclined face 390 of the second slider 122. This engagement causes the second slider 122 to move transversely (e.g., perpendicularly) relative to the movement of the first slider 114 in the direction of arrow C along the guide member 550 of the second housing 120 and at least partially through the second housing 120. Movement of the second slider 122 in the direction of arrow C causes the second clip 402 of the second slider to engage and move the inclined face 600 of the striker 128. In particular, the striker 128 moves in the direction of arrow D, which is the same direction as the second slider 122 moves out of the openings 614 and 606. Once the striker 128 is moved out of the openings, the glovebox 102 is able to be opened. Releasing of the push button 112 allows the first and second compression springs 310,312 to move the first slider 114 back through the opening 330 towards the dashboard 104. As the first slider 114 disengages from the second slider 122, the first and second compression springs 570,572 move the second slider 122 transversely toward the first housing 110 and away from the striker 128. The striker 128 then moves back through the openings 606, 604 thereby locking the glovebox 102. Thus, the exemplary opening and closing assembly 100 reduces the number of parts while maintaining performance.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An opening and closing assembly for an associated storage compartment provided on an associated vehicle comprising:

a first housing;

a push button movably supported on the first housing, the push button including a first slider having a first inclined face at a rear end thereof;

a second housing separate from the first housing and mounted adjacent the first housing;

a second slider movably supported on the second housing, the second slider including at least one clip on one end directly connecting the second slider to the second housing and a second inclined face on the other end, a longitudinal axis of the second slider being substantially perpendicular to a longitudinal axis of the first slider such that the second inclined face faces the first inclined face of the first slider, the at least one clip of the second slider being movable toward a striker to unlock the associated storage compartment when the second inclined face is pressed by the first inclined face.

2. The assembly of claim 1, including at least one biasing member provided in the first housing for biasing the push button outwardly relative to the first housing.

3. The assembly of claim 2, wherein the at least one biasing member includes a first compression spring and a second compression spring, each compression spring has one end portion connected to a projection provided on the push button and extending toward the first inclined face and the other end portion connected to a projection provided on an inner surface of the first housing, the projections of the push button being separated by the first slider.

4. The assembly of claim 1, wherein the push button includes a generally box-shaped base member, at least one clip for connecting the push button to the first housing and the first slider extending outwardly from a bottom surface of the base member.

5. The assembly of claim 4, wherein a top surface of the base member including at least one opening, and further including a button, the button having at least one clip configured to be securely received in the at least one opening provided in the top surface of the base member, the top surface of the base member further including at least one rib for controlling the location of the button on the top surface.

6. The assembly of claim 4, wherein the base member includes an overstroke ledge provided on a side wall thereof, the overstroke ledge preventing the push button from being overstroked past a predetermined length.

7. The assembly of claim 6, wherein the first housing includes an overstroke ledge which is selectively engaged by the overstroke ledge provided on the base member of the push button, and further including at least one tuning rib provided on an inner surface of the first housing for preventing the push button from rotating or moving up and down during stroke of the push button within the first housing.

8. The assembly of claim 1, including at least one biasing member for biasing the second slider toward the first slider.

9. The assembly of claim 8, wherein the at least one biasing member includes a first compression spring and a second compression spring, each compression spring has one end portion connected to a projection provided on the second slider and extending away from the second inclined face and the other end portion connected to a projection provided on an outer surface of the second housing.

10. The assembly of claim 1, wherein the second housing includes a guide rib located on an inner surface thereof, the guide rib engaging the second slider and providing a track for the second slider to travel.

11. The assembly of claim 10, wherein the second slider includes an elongated channel dimensioned to slidably receive the guide rib of the second housing.

12. The assembly of claim 1, wherein both the first housing and the associated storage compartment include a guide hole through which the striker of the associated storage compartment is locked or unlocked, the guide holes, the striker, and the second slider being co-axially aligned, one end portion of the striker being wedge shaped.

13. An opening and closing assembly for an associated storage compartment provided on an associated structure of a vehicle comprising:

a first housing for mounting on the associated vehicle structure;

a push button movably supported on the first housing, the push button including an overstroke member for preventing the push button from being overstroked past a predetermined length and a first slider having a first inclined face at a rear end thereof;

a second housing mounted to one of the first housing and the associated vehicle structure, the second housing including a guide member; and a second slider supported on the second housing and movable on the guide member, the second slider having a second inclined face on one end corresponding to the first inclined face of the first slider, the second slider being movable in a transverse direction relative to the first slider to unlock the associated storage compartment when the second inclined face is biased transversely by the first inclined face, the second slider including an elongated channel having an open first end portion dimensioned to slidably receive the guide member and a second end portion longitudinally spaced from the first end portion and closed by the second inclined face.

14. The assembly of claim 13, wherein the push button includes a base member, the first slider extending outwardly from a bottom surface of the base member, and further including a button connected to a top surface of the base.

15. The assembly of claim 14, wherein the base member includes the overstroke member provided on a side wall thereof, and the first housing includes an overstroke ledge which is selectively engaged by the overstroke member.

16. The assembly of claim 13, wherein the first housing includes at least one tuning rib provided on an inner surface of the first housing, the at least one tuning rib selectively engaging the push button to prevent the push button from rotating or moving up and down during stroke of the push button within the first housing.

17. The assembly of claim 13, wherein the second slider includes a clip for connecting the second slider to the second housing, the clip being positioned on the other end of the second slider, the clip engaging a striker of the glovebox to unlock the glovebox.

18. The assembly of claim 13, further including at least one biasing member associated with the first housing for biasing the first slider away from the second slider, and at least one biasing member associated with the second housing for biasing the second slider toward the first slider.

19. An opening and closing assembly for a glovebox provided on a dashboard of a vehicle comprising:

a first housing for mounting on one of the glovebox and the dashboard;

a push button movably supported within the first housing, the push button including a first slider having a first inclined face at a rear end thereof, the first inclined face projecting outwardly from a rear end of the first housing;

a second housing separate from the first housing and mounted to a flange extending outwardly from the first housing, the second housing including a guide member provided on an inner surface thereof;

a second slider supported on and extending through the second housing, the second slider having an elongated channel dimensioned to slidably receive the guide member and a second inclined face corresponding to the first inclined face of the first slider, the second slider being movable in a transverse direction relative to the first slider and engaging a striker projecting at least partially through an opening in the flange of the first housing to unlock the glovebox when the second inclined face is biased transversely by the first inclined face;

at least one biasing member associated with the first housing for biasing the first slider away from the second slider; and at least one biasing member associated with the second housing for biasing the second slider toward the first slider.

* * * * *